US008070277B2

(12) United States Patent
Phillips et al.

(10) Patent No.: US 8,070,277 B2
(45) Date of Patent: Dec. 6, 2011

(54) INK-JET PRINTER COMPRISING A STRUCTURE TO ELIMINATE INK DRIPPING

(75) Inventors: Scott Phillips, West Henrietta, NY (US); Roger Leighton, Hilton, NY (US); Nathan Smith, Hamlin, NY (US); Robert Tuchreio, Williamson, NY (US)

(73) Assignee: Xerox Corporation, Norwalk, CT (US)

( * ) Notice: Subject to any disclaimer, the term of this patent is extended or adjusted under 35 U.S.C. 154(b) by 551 days.

(21) Appl. No.: 12/338,204

(22) Filed: Dec. 18, 2008

(65) Prior Publication Data

US 2009/0102906 A1 Apr. 23, 2009

Related U.S. Application Data

(63) Continuation-in-part of application No. 11/773,549, filed on Jul. 5, 2007, now Pat. No. 7,828,423.

(51) Int. Cl.
*B41J 2/185* (2006.01)
*B41J 2/165* (2006.01)

(52) U.S. Cl. ..... 347/90; 347/35

(58) Field of Classification Search ..... 347/90, 347/31–36, 65, 55, 40
See application file for complete search history.

(56) References Cited

U.S. PATENT DOCUMENTS

| | | | | |
|---|---|---|---|---|
| 4,889,560 | A | 12/1989 | Jaeger et al. | |
| 5,389,958 | A | 2/1995 | Bui et al. | |
| 7,380,903 | B2 * | 6/2008 | Kachi | 347/33 |
| 7,467,845 | B2 * | 12/2008 | Takatsuka et al. | 347/35 |
| 7,703,878 | B2 * | 4/2010 | Koase | 347/23 |
| 7,883,175 | B2 * | 2/2011 | Otsuka et al. | 347/32 |

* cited by examiner

*Primary Examiner* — Kristal Feggins
(74) *Attorney, Agent, or Firm* — Ronald E. Prass, Jr.; Prass LLP

(57) ABSTRACT

This invention provides an ink jet assembly that prevents and controls ink drips from upper print heads from contacting the lower print heads or paper in the system. A heated ink drip bib is provided below the ink jet releasing portion of a print head. This ink drip bib directs falling or dripping ink into a drip tray located below each ink bib during the purge cycle. The ink bibs and the drip trays are co-extensive so that any ink being deflected from the ink bib is caught by the ink tray. In one embodiment, the ink bib is angled away from the printing surface to ensure that any solidified ink is separated from an imaging surface.

14 Claims, 3 Drawing Sheets

INK-JET PRINTER COMPRISING A STRUCTURE TO ELIMINATE INK DRIPPING

This application is a Continuation-In-Part of pending present application Ser. No. 11/773,549 filed in the U.S. Patent and Trademark Office on Jul. 5, 2007. The present invention relates to ink-jet printing and, more specifically, to the structure of the ink-jet print head assembly.

BACKGROUND

The use of an array of print heads in ink-jet printing is well known in the art as disclosed in the above-noted pending parent application Ser. No. 11/773,549. Briefly, ink-jet printing comprises ejecting ink droplets from orifices in a print head onto some type of receiving media to form a desired image. Generally, this formed image comprises a grid-like pattern of drop locations usually referred to as pixels. Often, the image resolution is indicated by the number of ink drops or dots per inch (dpi) commonly having a resolution of from about 300 dpi to about 600 dpi. The disclosure of parent application Ser. No. 11/773,549 details this ink jet process precisely and is totally incorporated by reference into the present disclosure.

U.S. Pat. No. 5,389,958, assigned to the assignee of the present application, is an example of an indirect or offset printing architecture that utilizes phase change ink. The ink is applied to an intermediate transfer surface in molten form having been melted from its solid form. The ink image solidifies on the liquid intermediate transfer surface by cooling to a malleable solid intermediate state as the drum continues to rotate. When the imaging has been completed, a transfer roller is moved into contact with the drum to form a pressurized transfer nip between the roller and the curved surface of the intermediate transfer surface/drum. A final receiving web such as a sheet of media is then fed into the transfer nip and the ink image is transferred to the final receiving web.

Inks usable in the present invention are like those described in U.S. Pat. No. 5,389,958 and U.S. Pat. No. 4,889,560. The disclosures of U.S. Pat. No. 5,389,950 and U.S. Pat. No. 4,889,560 are also incorporated by reference into the present disclosure. U.S. Pat. No. 5,389,958 indicates "the ink used to form the ink image preferably must have suitable specific properties for viscosity. Initially, the viscosity of the molten ink must be matched to the requirements of the ink jet device utilized to apply it to the intermediate transfer surface and optimized relative to other physical and rheological properties of the ink as a solid, such as yield strength, hardness, elastic modulus, loss modulus, ratio of the loss modulus to the elastic modulus, and ductility. The viscosity of the phase change ink carrier composition has been measured on a Ferranti-Shirley Cone Plate Viscometer with a large cone. At about 140° C. (older version of ink, the current is 120 C) a preferred viscosity of the phase change ink carrier composition is from about 5 to about 30 centipoise, more preferably from about 10 to about 20 centipoise and most preferably from about 11 to 15 centipoise. The surface tension of suitable inks is between about 23 and about 50 dynes/centimeter. An appropriate ink composition is that described in U.S. Pat. No. 4,889,560 issued Dec. 26, 1989 and assigned to the assignee of the present invention.

Such an ink has a composition comprising a fatty amide-containing material employed as a phase change ink carrier composition and a compatible colorant. The fatty amide-containing material comprises a tetraamide compound and a monoamide compound. The phase change ink carrier composition is in a solid phase at ambient temperature and in a liquid phase at elevated operating temperature. The phase change ink carrier composition can comprise from about 10 to about 50 weight percent of a tetraamine compound, from about 30 to about 80 weight percent of a secondary monoamide compound, from about 0 to about 40 weight percent of a tackifier, from about 0 to about 25 weight percent of a plasticizer, and from about 0 to about 10 weight percent of a viscosity modifying agent."

As noted in the above referenced prior art patents, the usable ink also used in the present invention is in a solid phase at ambient temperature and in a liquid phase at elevated operating temperatures.

High speed direct ink-jet marking is enabled by arranging modular print heads in staggered arrays to cover the process width. The architectures for these marking engines typically have many heads to provide the needed speed and resolution. The 6-color fixture uses a plurality of solid ink print heads. In previous 'print on drum' printer configurations, the head purge will force the ink to flow from the orifices and run down the print face into a drip bib which directs the flow between the heads and drops in a waste tray. In a direct to paper implementation, the plane of the head is 0.8 mm from the paper thus the drip bib sheet metal which extends beyond the head face will tear the paper. Thus a new style drip bib is required which is flat and does not break the plane of the head and hit the web. The print heads are arranged so that any free dripping ink from the drip bib will not land on the top of a head. Unfortunately, the free ink will land on paper below the head. In the present invention, to stop the ink from dripping, it would be helpful to freeze the ink between the heads so that the ink can be released when a maintenance cycle is performed. When a drip tray is placed below the drip bib, it can be heated to release the drip into a tray.

SUMMARY

In the present invention, the drip bib has a heater element on the lower formed surface. A slot is cut into the bib sheet metal to help create a thermal break between the upper half which is attached to the head and the lower half immersed in free air. The slot is filled in with Sylgard 577 adhesive or any compatible material that has similar properties to allow the ink to flow to the bottom of the bib without dripping through the slot and onto the heads below. The thermal break to allows separation between the head heat heaters and the drip bib heater and allows the tip of the drip bib to cool sufficiently <75 C to allow drip freezing. It is essential that the drips do not drop from the drip bib onto the paper. If a drip falls on the paper, there is a risk that the hard drip will damage the aperture plate because the gap between the head and the roller is, in one embodiment, 0.8 mm The paper will draw the drip through the gap and dent the aperture plate. It is also important to prevent drips from contaminating and smearing the image on the paper. The heater allows complete control of the freeze/thaw action on the last drip after the maintenance cycle is completed. The plate is thin, low mass which allows the freeze off to occur within three minutes after shutting off the heater.

As above noted, phase change inks are in solid phase at ambient temperature but exist in liquid phase at the elevated operating temperature of an ink jet printing device. Liquid phase ink jet drops at the operating temperature are ejected from the printing device and, when the ink drops contact the surface of a wide variety of printing media, they quickly solidify to form a predetermined pattern of solidified ink drops.

Phase change ink is desirable since it remains in a solid phase at room temperature during shipping, long-term storage, etc. The purge cycle attempts to clean missing jets by use of flushing ink through the aperture plate at 4 psi for 4.5 sec which results in 10 gms of waste ink that runs down the bib. Furthermore, since the ink droplets solidify immediately upon contact with the substrate, migration of ink along the printing medium is prevented and dot quality is improved.

The print head comprises a plurality of orifices or openings from which the ink jets out which is called the jet stack. The present invention comprises a drip bib just below this jet stack so that any free dripping ink from the drib bib will not land on the top of a head or on a paper-receiving sheet. To stop the ink from dripping, the ink is frozen between the heads so that the solidified ink can be disposed of when a maintenance cycle is performed. When the drip tray is placed below the drip bib, it can be heated to release the drip into the tray.

DETAILED DISCUSSION OF DRAWINGS AND PREFERRED EMBODIMENTS

Figure 1:
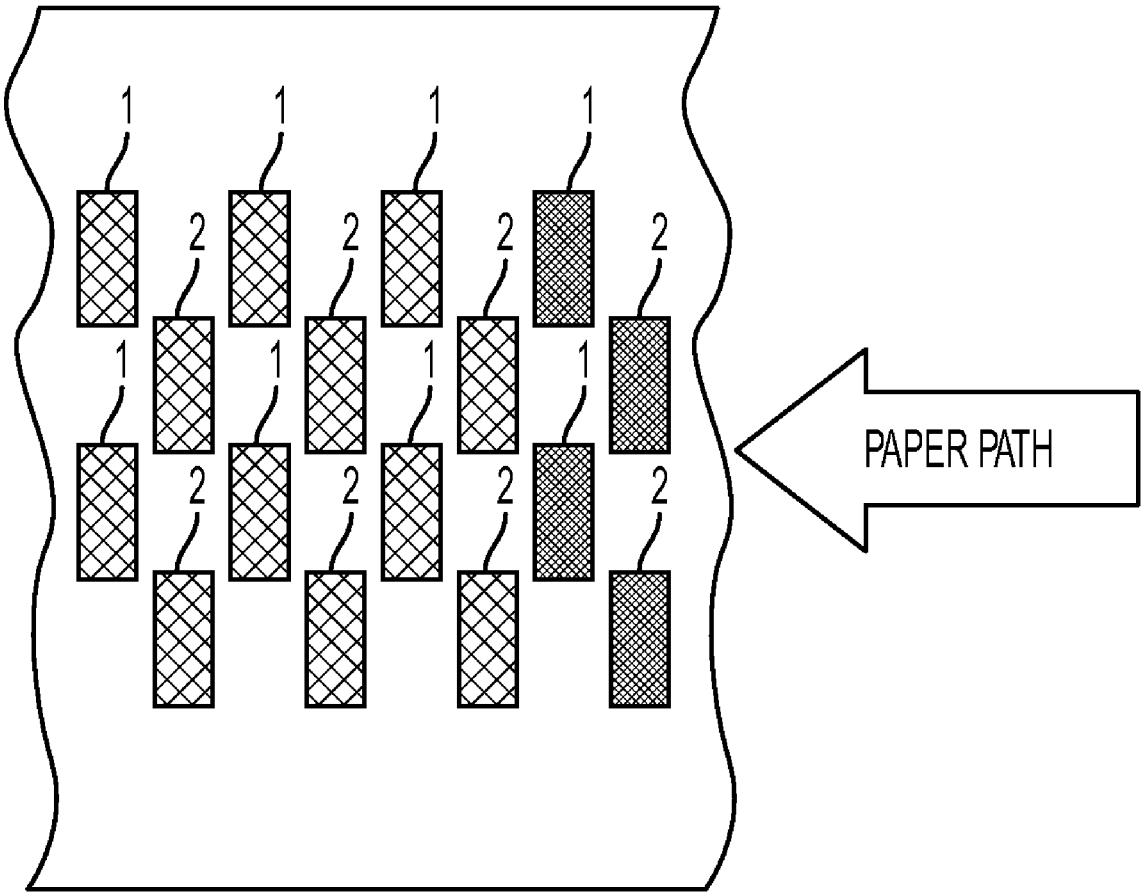
FIG. 1 illustrates a top or straight on view of an embodiment where the print heads of this invention are staggered to minimize dripping ink landing on top of an adjacent head.

In FIG. 1, a top view of the placement of print heads is shown in a staggered arrangement to minimize ink from the upper heads 1 dripping on the tops 3 of lower heads 2 in the Jupiter architecture. The direct to paper drip bib has no control of the drip point between the heads, thus requires a tray to be placed directly below the bib prior to purge. Therefore; ink drips could fall on the inbetween print heads and the free ink could land on paper below the head. Thus, with the staggered print heads 1 and 2 together with the drip bibs 4 and drip trays 5, little if any residual ink falls on the below print heads 2 or paper being imaged because the remaining residual drips are frozen on the tip of the drip bib. Therefore, high speed direct marking is enabled by arranging modular print heads 1 and 2 in staggered arrays to cover the process width. The architectures for these marking engines typically have many heads 1 and 2 to provide the needed speed and resolution. The 6-color system uses 84 Maverick solid ink print heads 1 and 2. The print heads 1 and 2 are arranged so that the upper heads overhang the heads below so that some any free dripping ink from the drip bib 4 could land on the top of a head 3. Unfortunately, the free ink will land on paper below the head. To stop the ink from dripping, it would be helpful to freeze the ink between the heads so that the ink can be released when a maintenance cycle is performed. When a drip tray 5 is placed below the drip bib 4, it can be heated to release the drip into a tray 5.

Figure 2:
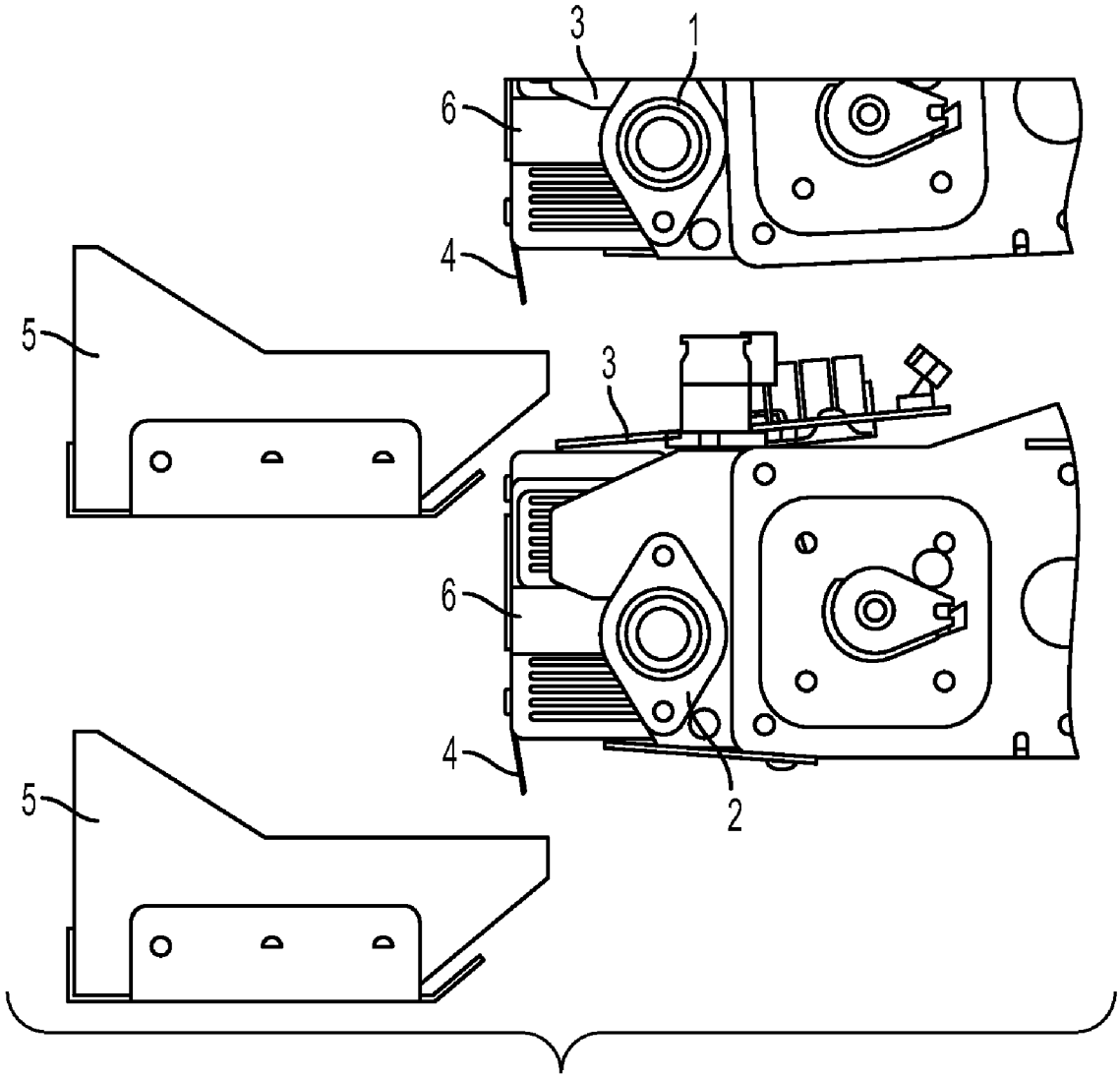
FIG. 2 is a side view of an embodiment of the print head assembly of this invention with the drip bib and drip tray in place.

In FIG. 2, an upper head 1 and a lower head 2 assembly are shown with an outer facing jet stack 6 made up of a plurality of apertures or orifices through which the liquefied ink passes during an imaging step. Below the jet stack 6 and extending there from, is a drip bib 4. To stop the liquid ink from dripping, the ink is frozen between the heads 1 and 2 so that the ink can be released from the heads 1 and 2 when a maintenance cycle is performed on the assembly. When the drip tray 5 is placed below the drip bib 4, it can be heated to release the drip in liquid form into the drip tray 5. The tray 5 is then cleaned out to remove the then solidified residual ink from the assembly.

Figure 3:
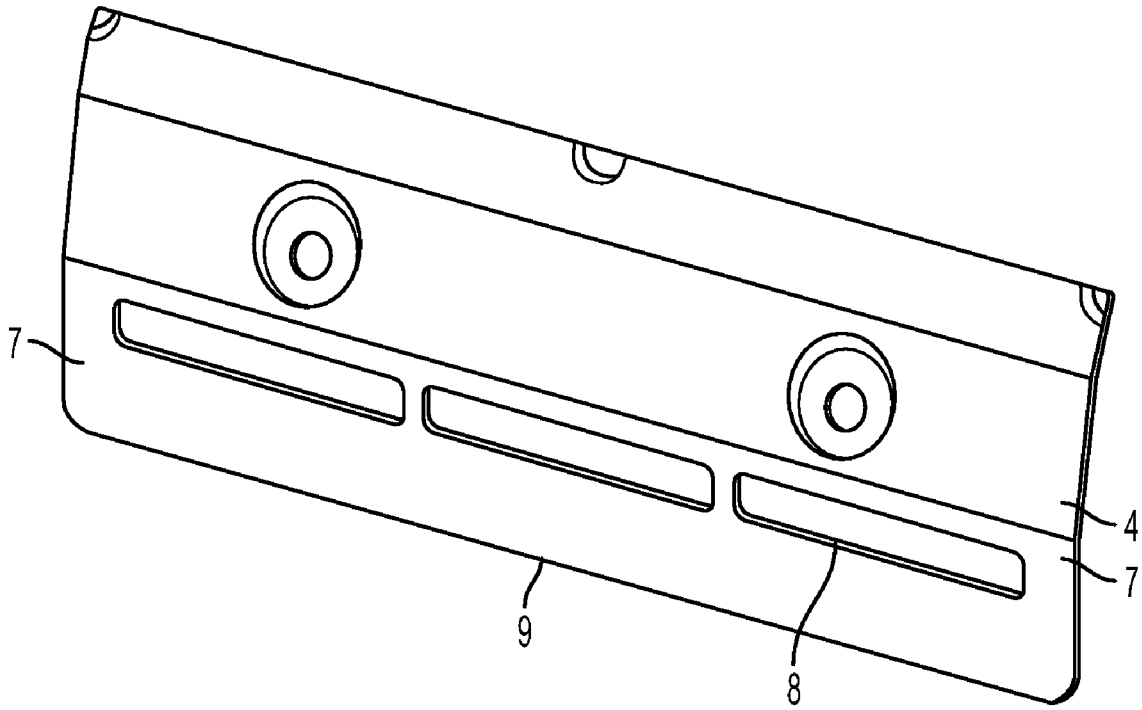
FIG. 3 is a perspective view of an embodiment of the drip bib used in the present invention.

As heads 1 and 2 drool, the ink will run down the head face, release off the drip bib 4 and land on the paper path. It has been observed that hard ink can damage a print head when it squeezes between a paper roll and head face. The jet stack 6 will have dent marks affecting the head performance. To stop the ink from dripping, the drip bib 4 can be extended longer and have segments cut out so that the heat from the head will get reduced enough to freeze ink as it approaches the bottom of the drip bib 4. A heater would be added so that when it is desired to remove the unwanted ink, one would turn on the heat with a drip tray 5 below the drip bib 4. The drip bib 4 could also have a bend as shown in the picture of FIG. 3 making the frozen ink get even further away from the paper. Finite element analysis shows a considerable bottom edge temperature reduction by placing a low thermal conductivity filler in the "thermal break" cut outs.

In FIG. 3, an embodiment of a drip bib 4 of the present invention is illustrated. In this embodiment, the drip bib 4 has a heater element 7 on the lower formed surface. The slot in the plate is filled in with Sylgard 577 adhesive. This acts as a thermal break 8 to separate the head heat heaters 7 from the bottom of the tip of the drip bib 4 to allow drip freezing and to keep ink from running down the back of the bib potentially attacking the adhesive holding the heater on the bib. It is essential that the drips do not drop from the drip bib 4 onto the paper. If a drip falls on the paper, there is a risk that the hard drip will damage the aperture plate because, in one instance for example, the gap between the heads 1 and 2 and the roller is 0.8 mm. The paper will draw the drip through the gap and dent the aperture plate. It is also important to prevent drips from contaminating the image on the paper. The heater 7 allows complete control of the freeze/thaw action on the last drip after the maintenance cycle is completed. The plate of the drip bib 4 is thin, low mass which allows the freeze off to occur within 3 minutes after the heater is shut off. Note that the bib 4 is angled at 9 away from a printing surface to ensure that any solidified ink is well separated from an imaging surface.

In summary, this invention provides a system to control drips from print heads 1 and 2 in a solid ink jet printing system. Drips that occur during printing can cause dents in print heads 1 and 2 when they get wedged into the small gap between the head and the imaging surface or image defects as a drop lands on an image. This invention uses a drip bib 4 with a heater 7 attached to the back and a thermal break 8 between the heated area 7 and the part attached to the print heads. During the purge, the heater 7 maintains the bib 4 at a temperature that allows the ink to flow freely into a drip tray 5. During printing, the thermal break in the bib 4 ensures that the end is cool enough so ink no longer drips and solidifies ink that may dribble inadvertently from the head. In addition, the bib 4, in one embodiment, is angled away from the printing surface to ensure any solidified ink is well separated from the imaging surface.

In summary, the present invention provides a print head assembly useful in ink-jet printing comprising at least one array of upper positioned print heads, at least one array of lower positioned print heads, a drip bib located at a lower portion of at least some of said upper positioned print heads, and a drip tray positioned below each of the drip bibs. The print heads are staggered so that the upper positioned print heads overhang the lower positioned print heads.

The drip tray and the drip bibs are co-extensive providing the drip tray below all portions of the drip bib. The drip bib and the drip tray are below all print heads in the assembly. The drip bib is configured to permit any residual ink that drips from the print heads to the drip bib and then into the drip tray during a maintenance cycle of the assembly.

The drip bib comprises a heater and a thermal break between the heater and a bib part attached to a lower section of the print heads. In one embodiment, the bib is angled away from a printing surface to provide that any solidified ink is separated from an imaging surface. The drip bibs and the drip trays are attached to the print heads immediately below a jet stack of the print heads.

In another embodiment, a print head assembly useful in ink-jet printing comprises at least one array of upper positioned print heads, at least one array of lower positioned print heads, a drip bib located at a lower portion of at least some of the upper positioned print heads, and a drip tray positioned below each of the drip bibs. The print heads are staggered so that the upper positioned print heads overhang the lower positioned print heads and are not positioned immediately below the upper print heads but the drip bib does overlap slightly with the heads below thus the possibility exists that a drop could land on the head below. The drip bib has a heater element on its lower formed surface and at least one slot above this heater element which provides a thermal break to separate print head heaters from a bottom of a tip of the drip bib to allow drip freezing thereby.

It will be appreciated that variations of the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

What is claimed is:

1. A print head assembly useful in ink-jet printing comprising:

at least one array of upper positioned print heads, at least one array of lower positioned print heads, a drip bib located at a lower portion of at least some of said upper positioned print heads, and a drip tray positioned below each of said drip bibs, and said print heads staggered so that said upper positioned print heads overhang the lower-positioned print heads.

2. The print head assembly of claim 1 wherein said drip tray and said drip bibs are co-extensive providing said drip tray below all portions of said drip bib.

3. The print head assembly of claim 1 wherein said drip bib and said drip tray are below all print heads in said assembly.

4. The print head assembly of claim 1 wherein said drip bib is configured to permit any residual ink to drip from said print heads, to said drip bib and into said drip tray during a maintenance cycle of said assembly.

5. The print head assembly of claim 1 wherein said drip bib comprises a heater and a thermal break between said heater and a bib part attached to a lower section of said print heads.

6. The print head of claim 1 wherein said bib is angled away from a printing surface to provide that any solidified ink is separated from an imaging surface.

7. The print head assembly of claim 1 wherein said drip bibs and said drip trays are attached to said print heads immediately below a jet stack of said print heads.

8. A print head assembly useful in ink-jet printing comprising:

at least one array of upper positioned print heads, at least one array of lower positioned print heads, a drip bib located at a lower portion of at least some of said upper positioned print heads, and a drip tray positioned below each of said drip bibs, and said print heads staggered so that said upper positioned print heads overhang the lower-positioned print heads and are not positioned immediately below said upper print heads, said drip bib having a heater element on its lower formed surface and at least one slot above said heater element, said slot providing a thermal break to separate print head heaters from a bottom of a tip of the drip bib to allow drip freezing thereby.

9. The print head assembly of claim 8 wherein said drip tray and said drip bibs are co-extensive providing said drip tray below all portions of said drip bib.

10. The print head assembly of claim 8 wherein said drip bib and said drip tray are below all print heads in said assembly.

11. The print head assembly of claim 8 wherein said drip bib is configured to permit any residual ink to drip from said print heads, to said drip bib and into said drip tray during a maintenance cycle of said assembly.

12. The print head assembly of claim 8 wherein said drip bib comprises a heater and a thermal break between said heater and a bib part attached to a lower section of said print heads.

13. The print head of claim 8 wherein said bib is angled away from a printing surface to provide that any solidified ink is separated from an imaging surface.

14. The print head assembly of claim 8 wherein said drip bibs and said drip trays are attached to said print heads immediately below a jet stack of said print heads.

* * * * *